US007388145B1

(12) United States Patent
Olson et al.

(10) Patent No.: US 7,388,145 B1
(45) Date of Patent: Jun. 17, 2008

(54) UNMANNED UNDERWATER VEHICLE TAILCONE ASSEMBLY

(75) Inventors: Stanley J. Olson, Newport, RI (US); Stephen F. Oliver, Portsmouth, RI (US); Robert F. Doleski, Middletown, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 515 days.

(21) Appl. No.: 11/099,778

(22) Filed: Apr. 4, 2005

(51) Int. Cl.
*F42B 19/12* (2006.01)
*B63G 8/08* (2006.01)

(52) U.S. Cl. ..... 114/20.1; 114/20.2; 114/238; 114/338

(58) Field of Classification Search ..... 114/20.1, 114/20.2, 22, 23, 316–320, 337, 338, 238; 440/38–47; 416/133, 142, 150
See application file for complete search history.

(56) References Cited

U.S. PATENT DOCUMENTS 412,670 A * 10/1889 Ross ..... 102/376
2,828,603 A * 4/1958 Laucher ..... 60/761
3,347,491 A * 10/1967 Auguste et al. ..... 244/3.27
3,412,962 A * 11/1968 Killian ..... 244/130
3,717,114 A * 2/1973 Bernaerts ..... 114/338
3,834,626 A * 9/1974 Sevik et al. ..... 239/265.13
4,007,505 A 2/1977 Nowatzki
4,674,706 A * 6/1987 Hall ..... 244/3.3
4,944,226 A * 7/1990 Wedertz et al. ..... 102/476
5,038,559 A * 8/1991 Blackmore ..... 60/204
5,679,035 A * 10/1997 Jordan ..... 440/47
6,109,985 A 8/2000 Dubois et al.
6,293,836 B1 * 9/2001 Blanchard ..... 440/47

FOREIGN PATENT DOCUMENTS

GB 2343416 A * 5/2000
JP 01262290 A * 10/1989

* cited by examiner

*Primary Examiner*—Ajay Vasudeva
(74) *Attorney, Agent, or Firm*—James M. Kasischke; Michael P. Stanley; Jean-Paul A. Nasser

(57) ABSTRACT

A tailcone assembly for an undersea vehicle includes a first tailcone portion having a cavity and a second tailcone portion positionable in and axially extensible from the cavity. An extensible drive shaft is provided for joining the vehicle's engine to a propeller. The extensible drive shaft includes a first drive shaft joined to the engine, and a second drive shaft rotating with the first drive shaft. The second drive shaft is supported by the second tailcone portion and is axially extensible from the first drive shaft upon deployment of the second portion. The propeller is positioned on the second drive shaft outside the second portion. A biasing means is provided between the tailcone portions for deploying the second portion.

8 Claims, 3 Drawing Sheets

UNMANNED UNDERWATER VEHICLE TAILCONE ASSEMBLY

STATEMENT OF GOVERNMENT INTEREST

The invention described herein may be manufactured and used by and for the Government of the United States of America for Governmental purposes without the payment of any royalties thereon or therefor.

BACKGROUND OF THE INVENTION

1. Field of the Invention

The invention relates to submarine underwater countermeasure assemblies and is directed more particularly to an improved countermeasure vehicle.

2. Description of the Prior Art

In FIG. 1, there is shown a typical submarine countermeasure apparatus 20. The apparatus 20 includes a launch tube 22 which, in operation, is disposed outboard of the submarine pressure hull (not shown). A countermeasure vehicle 24 is housed in the launch tube 22 and includes an array assembly 26 and a tailcone assembly 28. The array assembly 26 is protected by a surrounding sabot 30. Disposed in the launch tube 22 is a ram plate 32 and a gas generator 34. The launch tube is closed by a forward tube cover 36 and an after tube cover 38.

In operation, the gas generator 34 is activated by an electrical pulse from the submarine fire control system and generates sufficient gas pressure to move the ram plate 32 forwardly. The ram plate 32 pushes the countermeasure vehicle 24 forwardly, breaking away the forward tube cover 36 and launching the countermeasure vehicle 24 from the launch tube 22. In short order, the sabot 30 disengages from around the array assembly 26 and the array assembly is deployed.

The tail cone assembly 28 includes a propulsion propeller assembly 40, and the countermeasure vehicle 24 houses a motor 42 (FIG. 2) which drives the propeller assembly to position the countermeasure vehicle 24 in a vertical column of water with the propeller oriented towards the surface.

It has been found that upon launch of the vehicle 24, a combination of a high velocity launch, high maneuvering speed of the submarine, and strong cross flows on the vehicle 24 hull from launching perpendicular to the submarine hull, can subject propeller blades 44 to pressures and bending movements sufficient to damage the propellers and the vehicle tail section. While providing some protection, the currently used tailcone assembly 28 is not sufficient to protect the propeller from damage under severe launching conditions. Damaged propellers can affect the ability of the countermeasure to hover at a selected depth in the water column, and thereby cause mission failure which places the submarine in a state of increased danger.

Accordingly, there is a need for an improved tailcone assembly which can withstand and survive the aforesaid launch conditions and which provides improved propeller protection against severe bending moments.

SUMMARY OF THE INVENTION

An object of the invention is, therefore, to provide an improved submarine countermeasure vehicle tailcone assembly which provides propeller protection during launch and deployment under conditions inflicting high bending moments upon the propeller.

With the above and other objects in view, a feature of the present invention is the provision of an unmanned underwater vehicle tailcone assembly. The assembly includes a first portion fixed to the vehicle and forming an after cavity in the vehicle, and a second portion disposed within the first portion cavity and slidably moveable therein, upon launch of the vehicle, to an exposed position extending aft from the vehicle.

The above and other features of the invention, including various novel details of construction and combinations of parts, will now be more particularly described with reference to the accompanying drawings and pointed out in the claims. It will be understood that the particular assembly embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent, wherein corresponding reference characters indicate corresponding parts throughout the several views of the drawings and wherein.

DESCRIPTION OF THE PREFERRED EMBODIMENT

Figure 1:
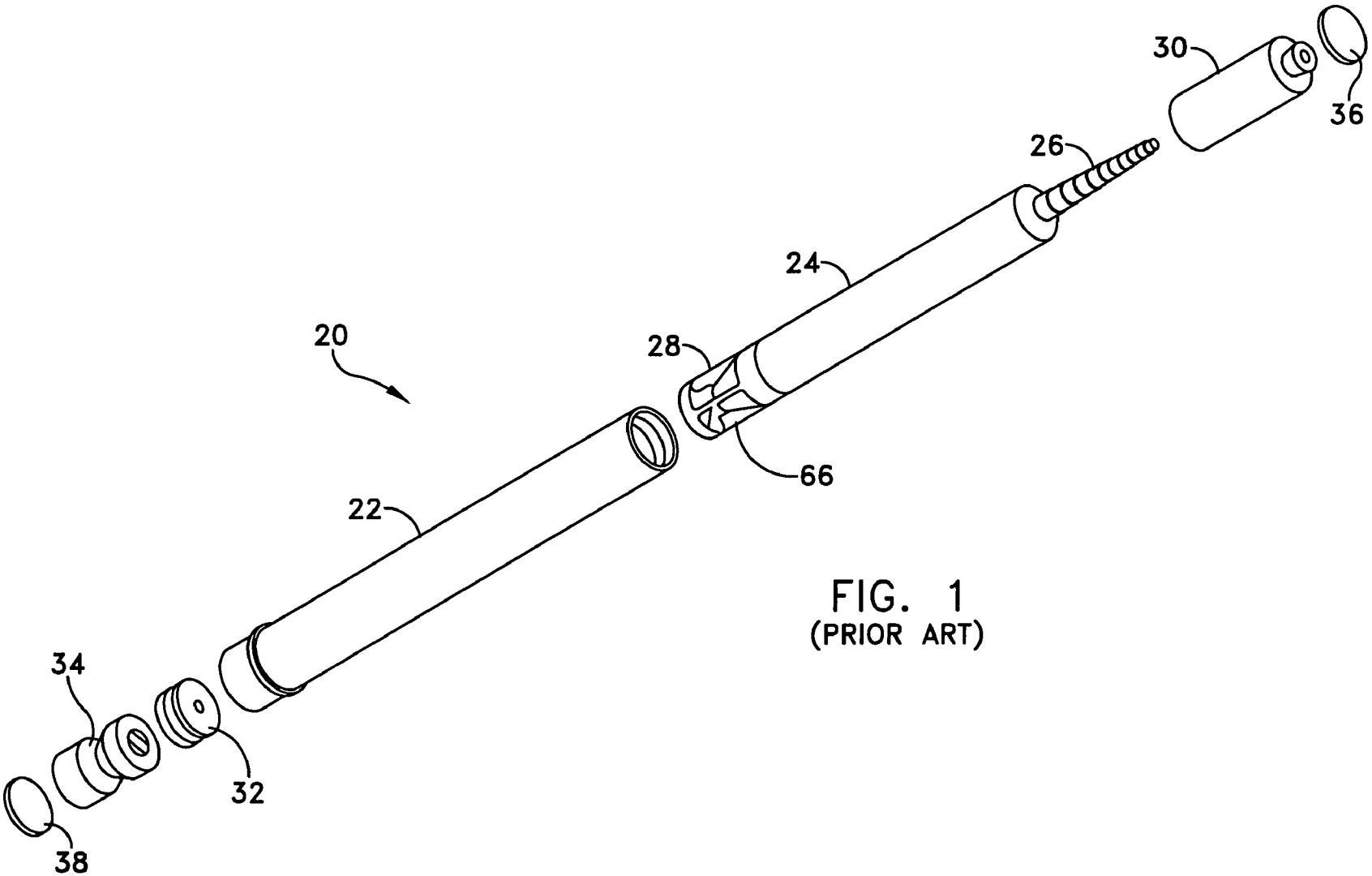
FIG. 1 (PRIOR ART)
FIG. 1 is an exploded perspective view of a prior art underwater vehicle including a tailcone assembly.
Figure 2:
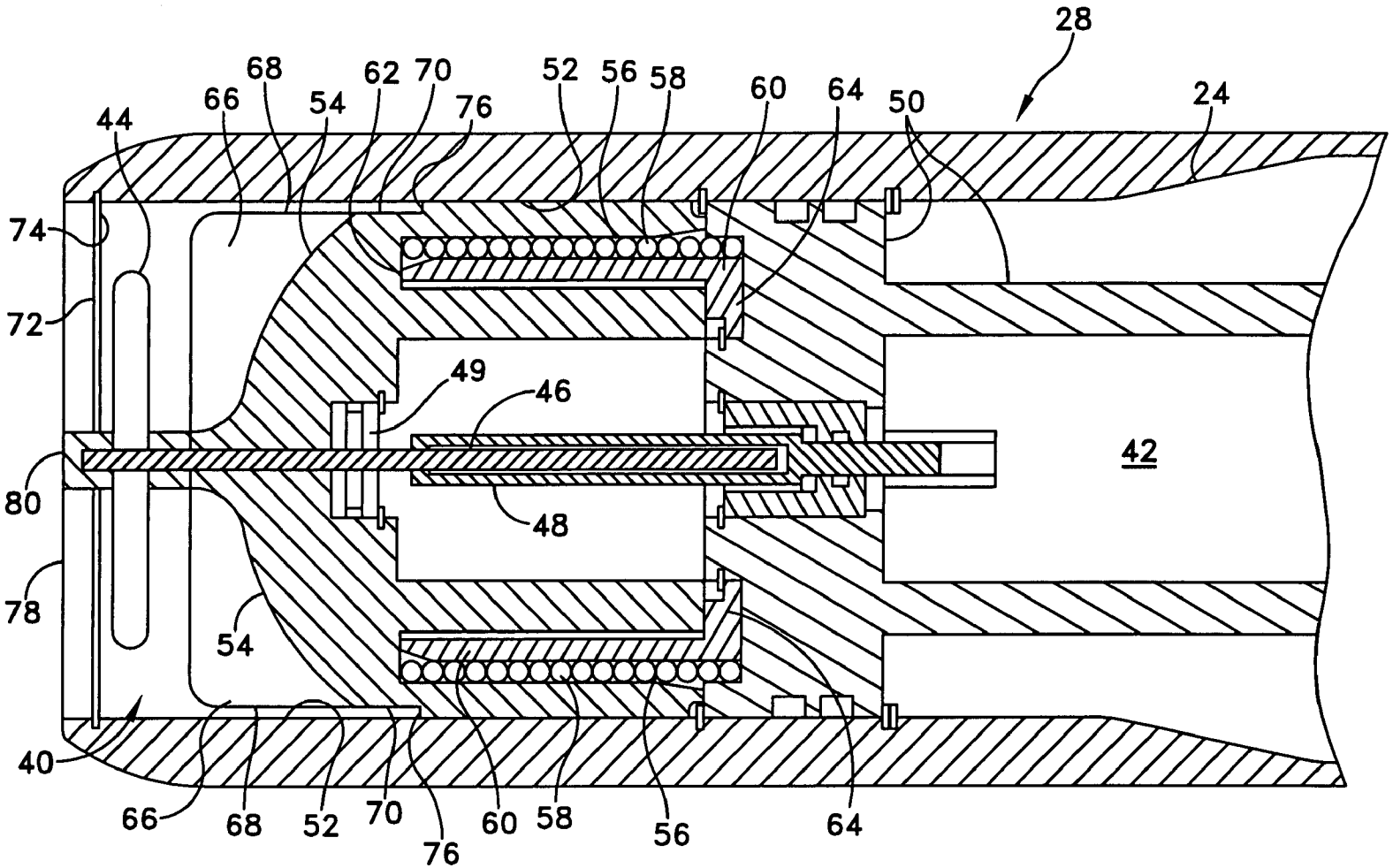
FIG. 2 is a sectional view of one form of a tailcone assembly illustrative of an embodiment of the invention.

Referring to FIG. 2, it will be seen that the tailcone assembly 28 includes a first portion 50 fixed to the vehicle 24, and forming a cavity 52.

Disposed in the cavity 52 is a tailcone assembly second portion 54 which is slidably moveable in the cavity 52. Second portion 54 can be prevented from rotating by mating grooves and lands on the interior surface of first portion cavity 52 and the exterior of second portion 54. The tailcone assembly second portion 54 comprises a reciprocally moveable tailcone on which is mounted the propeller assembly 40. The propeller assembly 40 includes a propeller shaft 46 and the propeller blades 44.

The propeller assembly motor 42 is connected to a sealed hollow output drive shaft 48 and is operative to rotatably drive the shaft 48. The propeller shaft 46 is slidably disposed in the drive shaft 48. The shafts 46, 48 are configured by using splines or other mating structures such that rotation of the drive shaft 48 is transmitted to the propeller shaft 46, but the propeller shaft 46 is free to move axially in the drive shaft 48. A bi-directional thrust bearing 49 connects the propeller shaft 46 to tailcone second portion 54.

The tailcone second portion 54 is provided with an annular recess 56, the open end of which faces the tailcone assembly fixed portion 50 and the interior of the vehicle. A coil spring 58 is mounted in the recess 56, extending from an end wall 62 of the annular recess 56 to tailcone assembly fixed portion 50. An annular ring 60 having a flanged portion 64 is provided against tailcone assembly fixed portion 50. Annular ring 60 stabilizes spring 58 and assists in assembly. Prior to deployment, annular ring 60 extends into annular recess 56.

Fins 66 extend from the after surface of the tailcone second portion 54. Outer edges 68 of the fins 66 are in alignment with interior walls of an annular groove 70 in the tailcone fixed portion 50. An annular stop member 72 is mounted at the after end of the tailcone assembly and extends inwardly to provide an exposed annular surface 74 generally coextensive with an annular end wall 76 of the groove 70.

At rest in the launch tube 22, the tailcone second portion 54 is in the position shown in FIG. 2, wherein the propeller blades 44 are housed within the tailcone assembly cavity 52. The ram plate 32 is in contact with the after end surface 78 of the tailcone assembly 28 and an end hub 80 mounted on the after end of the propeller shaft 46. The vehicle hull 24 in FIG. 2 is shown as a continuous tailcone without a far aft joint to better withstand large bending moments on the vehicle hull 24.

Figure 3:
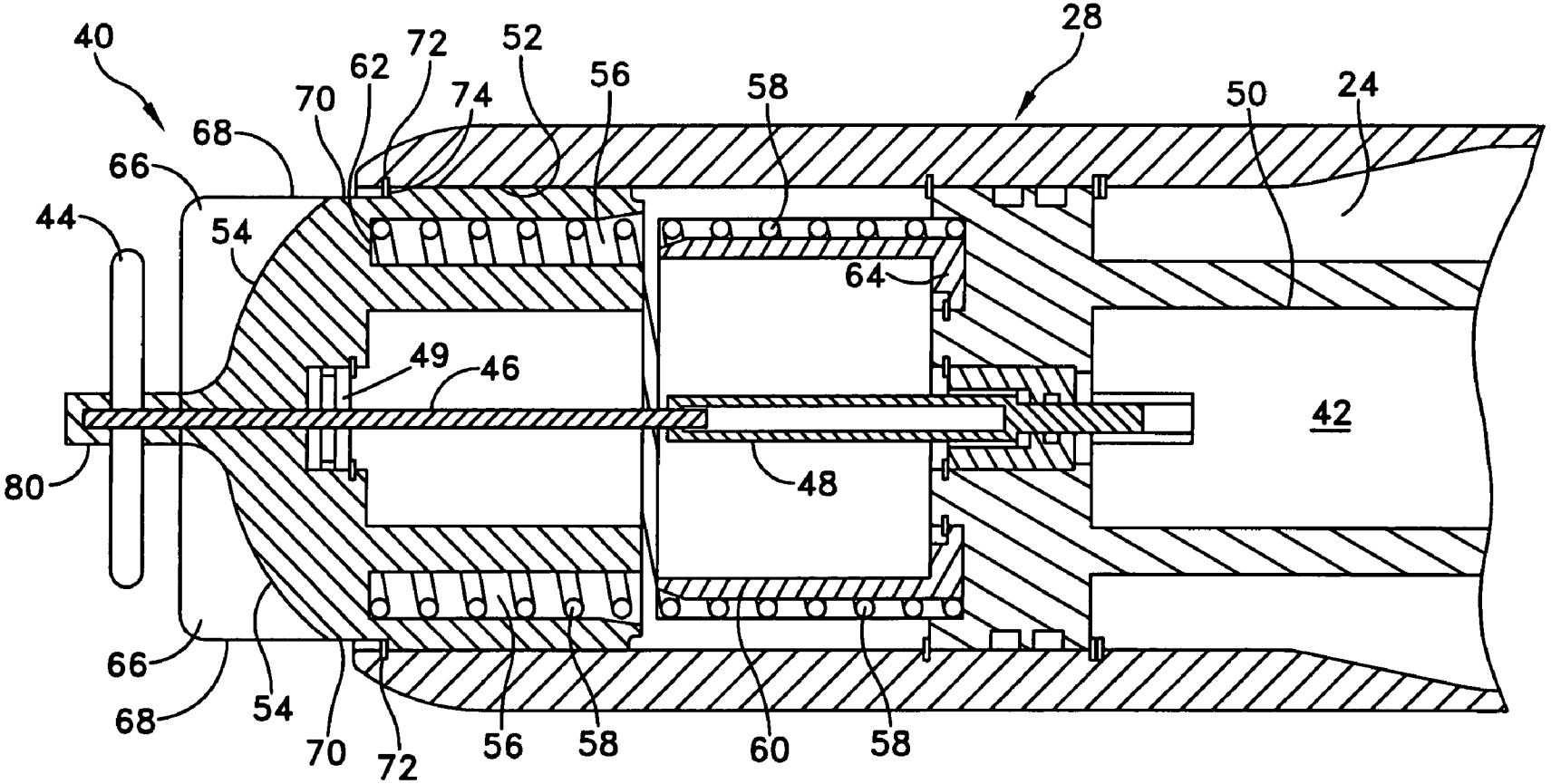
FIG. 3 is similar to FIG. 2, but showing the tailcone assembly of FIG. 2 in an alternative operative disposition.

Upon activation of the gas generator 34, gas under pressure forces the ram plate 32 to move rapidly toward the forward end of the launch tube 22. Movement of the ram plate 32 forces movement of the vehicle 24 forward, breaking away the forward tube cover 36, and ejecting the vehicle 24 from the launch tube. In the ejection process, the tailcone assembly 28 clears the launch tube with the propeller blades 44 shielded from the high bending moments of inrushing water by their disposition in the cavity 52. When the ram plate 32 reaches the forward end of the launch tube 22, the ram plate is stopped by wedge members (not shown) inside the launch tube. Prior to separation of the vehicle 24 from ram plate 32, tailcone second portion 54 is held against first portion 50 by ram plate 32. After separation of the vehicle 24 from the launch tube 22, the spring 58 urges the tailcone second portion 54 rearwardly from the protected position shown in FIG. 2 to the extended position shown in FIG. 3. Entry of environmental fluid into tailcone assembly cavity 52 prevents rapid deployment of the tailcone second portion 54. The second portion 54 stops its rearward movement when the tailcone groove end wall 76 engages the annular surface 74 of the stop member 72. At that point, the propeller blades 44 are exposed to water forces, but the violent launch bending moments will have receded. The motor 42 initiates rotation of propeller blades 44 to provide the propulsion power required to properly position the vehicle 24 and its acoustic array.

There is thus provided an improved submarine countermeasure vehicle tailcone assembly which provides protection of the propulsive propeller during launch conditions.

It will be understood that many additional changes in the details, materials, steps and arrangement of parts, which have been herein described and illustrated in order to explain the nature of the invention, may be made by those skilled in the art within the principles and scope of the invention as expressed in the appended claims.

What is claimed is:

1. A tailcone assembly for a vehicle comprising:

a first portion defining a cavity and being fixable to the vehicle;

a second portion disposed within the first portion cavity and slidably moveable therein, upon launch of the vehicle, to an exposed position extending aft from the vehicle;

a coil spring disposed in the cavity and biasing said second portion toward the exposed position; and a propulsor joined to said second portion and moveable with said second portion to the exposed position.

2. The tailcone assembly in accordance with claim 1 wherein said propulsor comprises:

a first drive shaft for joining to an engine on the vehicle;

a second drive shaft axially extensible from said first drive shaft and rotating with said first drive shaft; and a propeller joined to said second drive shaft and moveable with said second portion to the exposed position.

3. A tailcone assembly for an undersea vehicle comprising:

a first drive shaft for joining to an engine on said vehicle;

a second drive shaft axially extensible from said first drive shaft and rotating with said first drive shaft;

a propeller joined to said second drive shaft;

a first tailcone portion having a tailcone cavity defined by an inner surface of said first tailcone portion fixable to the vehicle;

a second tailcone portion positionable in and axially extensible from said tailcone cavity, said second tailcone portion having a shaft aperture formed therein accommodating said second drive shaft; and a biasing means positioned between said first tailcone portion and said second tailcone portion for biasing said second tailcone portion away from said first tailcone portion.

4. The assembly of claim 3 wherein said biasing means is a spring.

5. The assembly of claim 4 further comprising a spring retaining sleeve positionable on said first tailcone portion inside said spring.

6. The assembly of claim 3 wherein:

said first tailcone portion has a retaining member formed on the inner surface of said tailcone cavity; and said second tailcone portion having a retaining shoulder formed on an outer surface of said second tailcone portion, said retaining shoulder interfering with said retaining member for preventing overextension of said second tailcone portion.

7. The assembly of claim 6 further comprising fins positioned on said second tailcone portion outer surface.

8. The assembly of claim 7 wherein said first tailcone portion has fin grooves formed on the inner surface of said tailcone cavity for accommodating said fins.

* * * * *